US007179136B1

(12) United States Patent
Morello

(10) Patent No.: US 7,179,136 B1
(45) Date of Patent: Feb. 20, 2007

(54) ELECTRICAL CONNECTOR

(75) Inventor: John R. Morello, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/523,358

(22) Filed: Sep. 19, 2006

(51) Int. Cl.
*H01R 13/514* (2006.01)
*H01R 13/44* (2006.01)

(52) U.S. Cl. ..... 439/752; 439/140

(58) Field of Classification Search ..... 439/595, 439/752, 140, 144, 381
See application file for complete search history.

(56) References Cited

U.S. PATENT DOCUMENTS 5,201,674 A * 4/1993 Okura ..... 439/752
5,879,174 A 3/1999 Kountz et al.
5,980,318 A 11/1999 Morello et al.
5,993,255 A * 11/1999 Yurko ..... 439/595
6,004,158 A * 12/1999 Ward ..... 439/595
6,305,990 B1 * 10/2001 Ward ..... 439/752
6,409,525 B1 * 6/2002 Hoelscher et al. ..... 439/140
6,422,881 B1 * 7/2002 Puhl et al. ..... 439/140
6,761,568 B2 * 7/2004 Bakker et al. ..... 439/140
6,846,191 B2 * 1/2005 Hobbs et al. ..... 439/140

* cited by examiner

*Primary Examiner*—Briggitte R. Hammond
(74) *Attorney, Agent, or Firm*—David P. Wood

(57) ABSTRACT

An electrical connector has male terminals that are retained in terminal cavities of a connector body by rigid lock nibs and flexible cantilever beams that push the terminals against the rigid lock nibs. The male terminal have blades that project into a socket at a mating end of the connector body. A stabilizer that is disposed into the socket shifts between a preload position allowing terminal insertion into locked engagement in the connector body, and a stabilize position stabilizing the blades in the socket and enhancing the terminal retention in the terminal cavities.

13 Claims, 4 Drawing Sheets

ELECTRICAL CONNECTOR

BACKGROUND OF THE INVENTION

This invention relates generally to an electrical connector and more particularly to an electrical connector in which the connector body has flexible beams for enhancing terminal retention.

U.S. Pat. No. 5,980,318 granted to John Morello et al. Nov. 9, 1999 discloses an electrical connector comprising a connector body that has a plurality of terminal receiving cavities. Each terminal receiving cavity is defined in part by a rigid floor and opposed upright walls. A rigid lock nib extends upwardly from the rigid floor into the terminal receiving cavity. A flexible beam opposes the rigid floor and engages a terminal in the cavity to hold the terminal down against the rigid lock nib to retain the terminal in the terminal receiving cavity. The connector body is constructed and arranged for receiving a female terminal in each terminal receiving cavity. This electrical connector is well suited for its intended purpose of housing female terminals. However, the electrical connector is not well suited for housing male terminals that have contact blades or the like that project into a socket portion of the connector body.

U.S. Pat. No. 5,879,174 granted to Kountz et al. Mar. 9, 1999 discloses an electrical connector in which the connector body is constructed and arranged for receiving a male terminal in each terminal cavity with the male terminals having blades that protrude into a socket portion of the connector body. This electrical connector includes a male blade stabilizer that is inserted into the socket blades to align the protruding blades of the male terminals. The stabilizer is moved longitudinally from a forward prestaging position to a rearward staging position when a mating electrical connector is pushed into the socket portion. The male terminals are retained in the terminal cavities by flexible lock fingers.

SUMMARY OF THE INVENTION

This invention provides an electrical connector that has male terminals and a flexible beam in each terminal receiving cavity of a connector body for holding the male terminals down against a rigid lock nib to retain the male terminals in the connector body. The male terminals have blades that project into a socket portion of the connector body and the electrical connector includes a stabilizer that is disposed in the socket portion of the connector body. The stabilizer moves laterally from a preload position to a terminal stabilizing position. The stabilizer permits loading of the terminals in the preload position into the connector body. In the terminal stabilizing position, the stabilizer locates the male terminal blades in the socket and also enhances terminal retention.

DETAILED DESCRIPTION OF THE PREFERRED EMBODIMENTS

Figure 1:
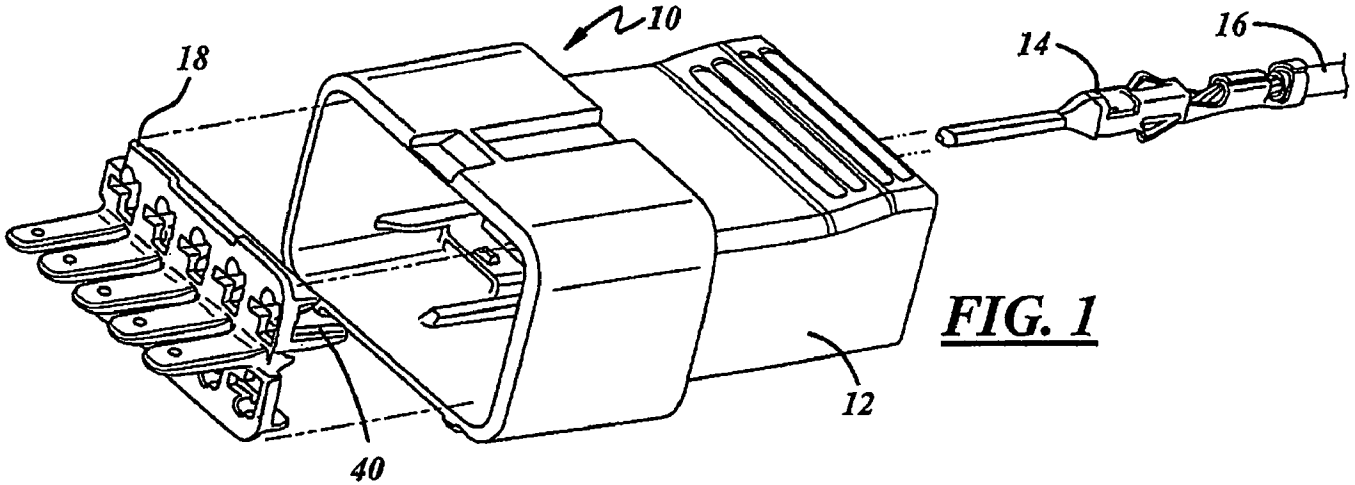
FIG. 1 is a perspective view of an electrical connector illustrating an embodiment of the invention.

Referring now to FIG. 1, electrical connector 10 comprises a connector body 12, a plurality of male terminals 14 attached to insulated conductor wires 16 and a stabilizer 18. Connector body 12 has two parallel rows of terminal cavities 20 that extend through the connector body 12 from openings at an insertion end 22 to openings into an integral socket 24 at a mating end 26 of the connector body.

Figure 6:
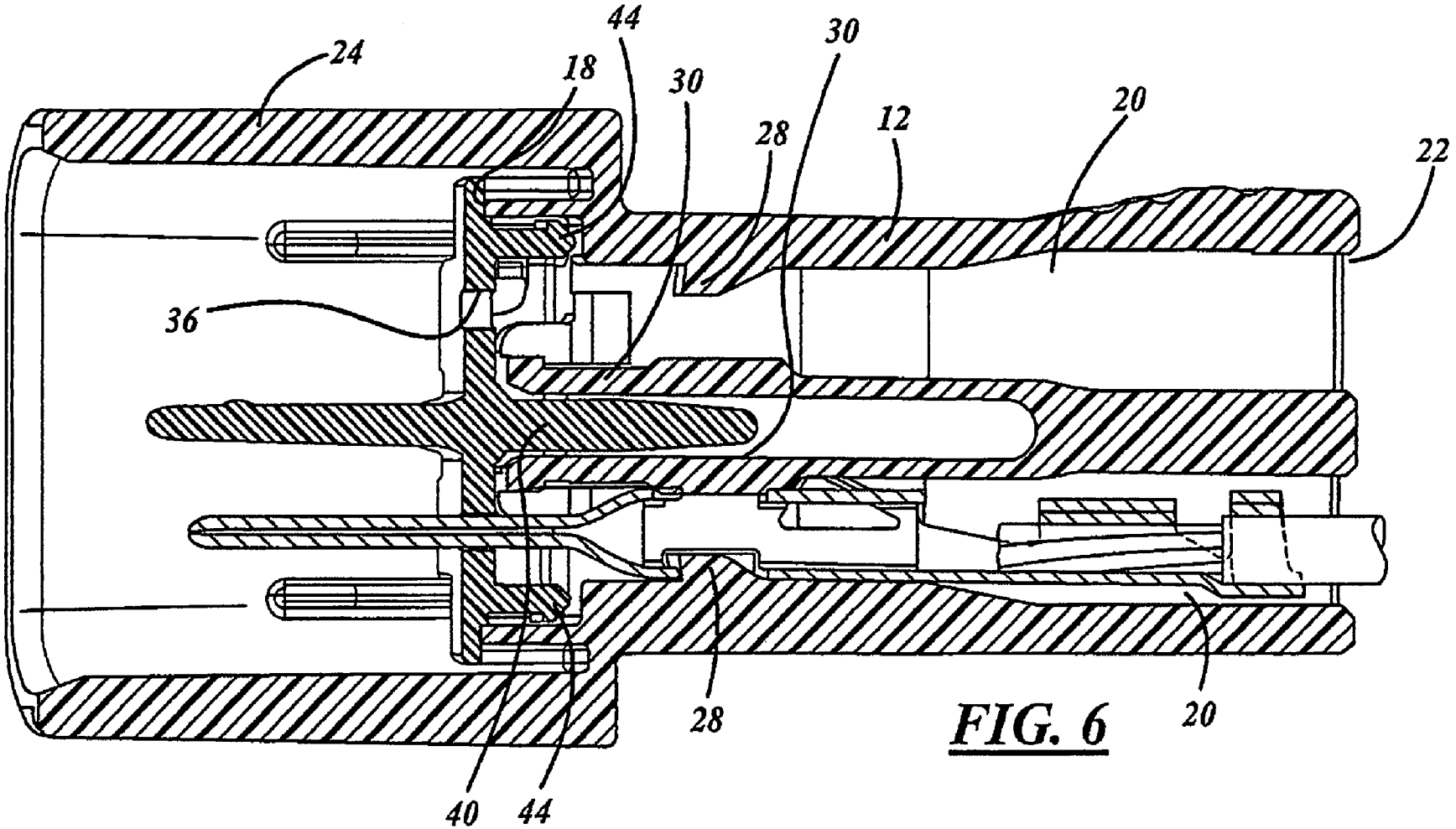
FIG. 6 is a longitudinal section of the electrical connector taken along the line 6—6 of FIG. 4 looking in the direction of the arrows.

Connector body 12 has rigid terminal locks 28 that project inward into the terminal cavities 20 for retaining the terminals 14 in the connector body 12 and cantilevered flexible beams 30 opposite the rigid terminal locks 28 for pushing the terminals 14 outward into locked engagement with the rigid terminal locks 28 as best shown in FIG. 6.

Figure 3:
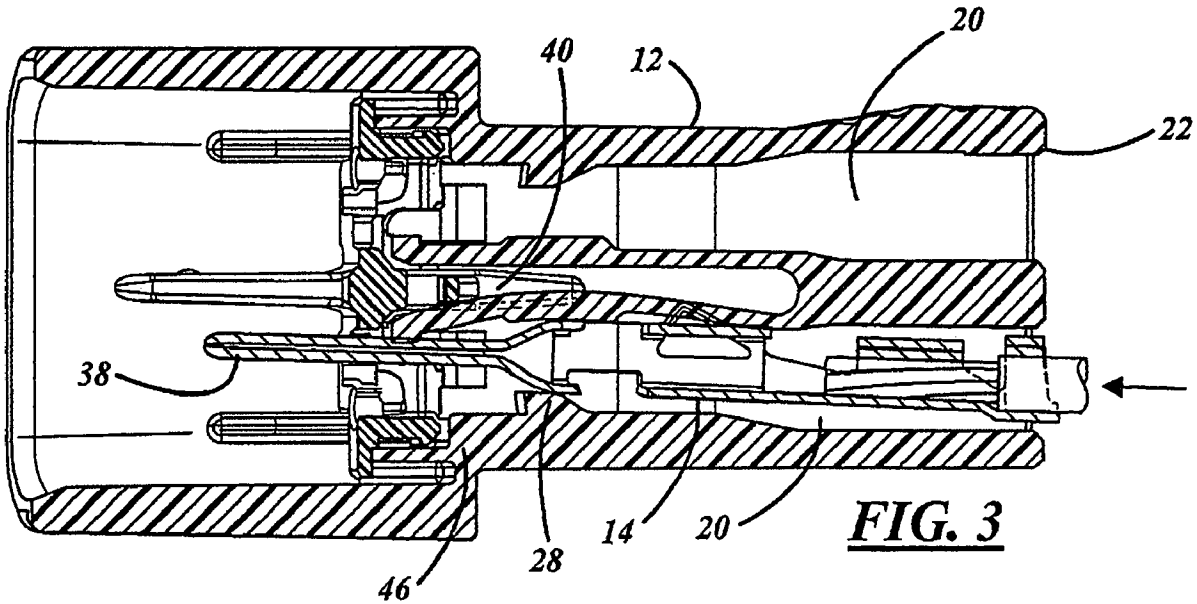
FIG. 3 is a longitudinal section of the electrical connector taken along the line 3—3 looking in the direction of the arrows of FIG. 2.
Figure 2:
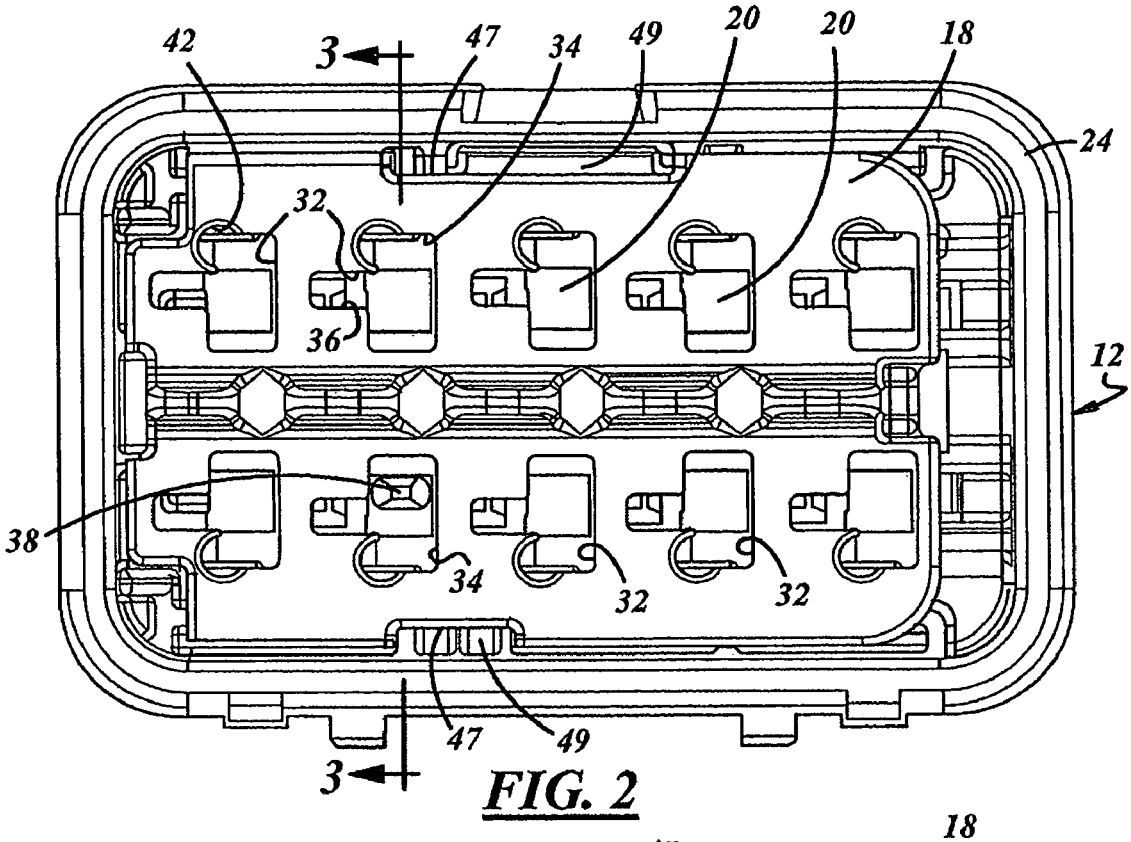
FIG. 2 is a front view of the electrical connector of FIG. 1 showing the stabilizer in a terminal loading position.
Figure 4:
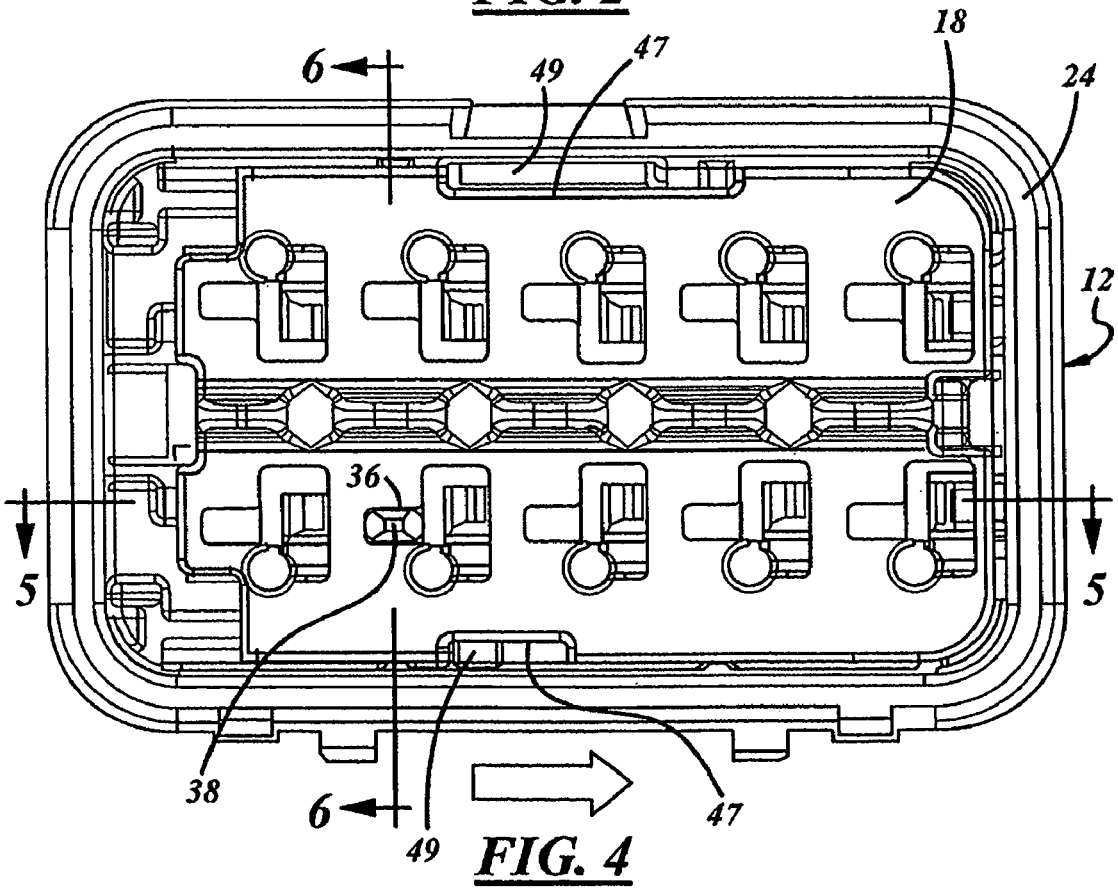
FIG. 4 is a front view of the electrical connector of FIG. 1 showing the stabilizer in a terminal stabilizing position.
Figure 5:
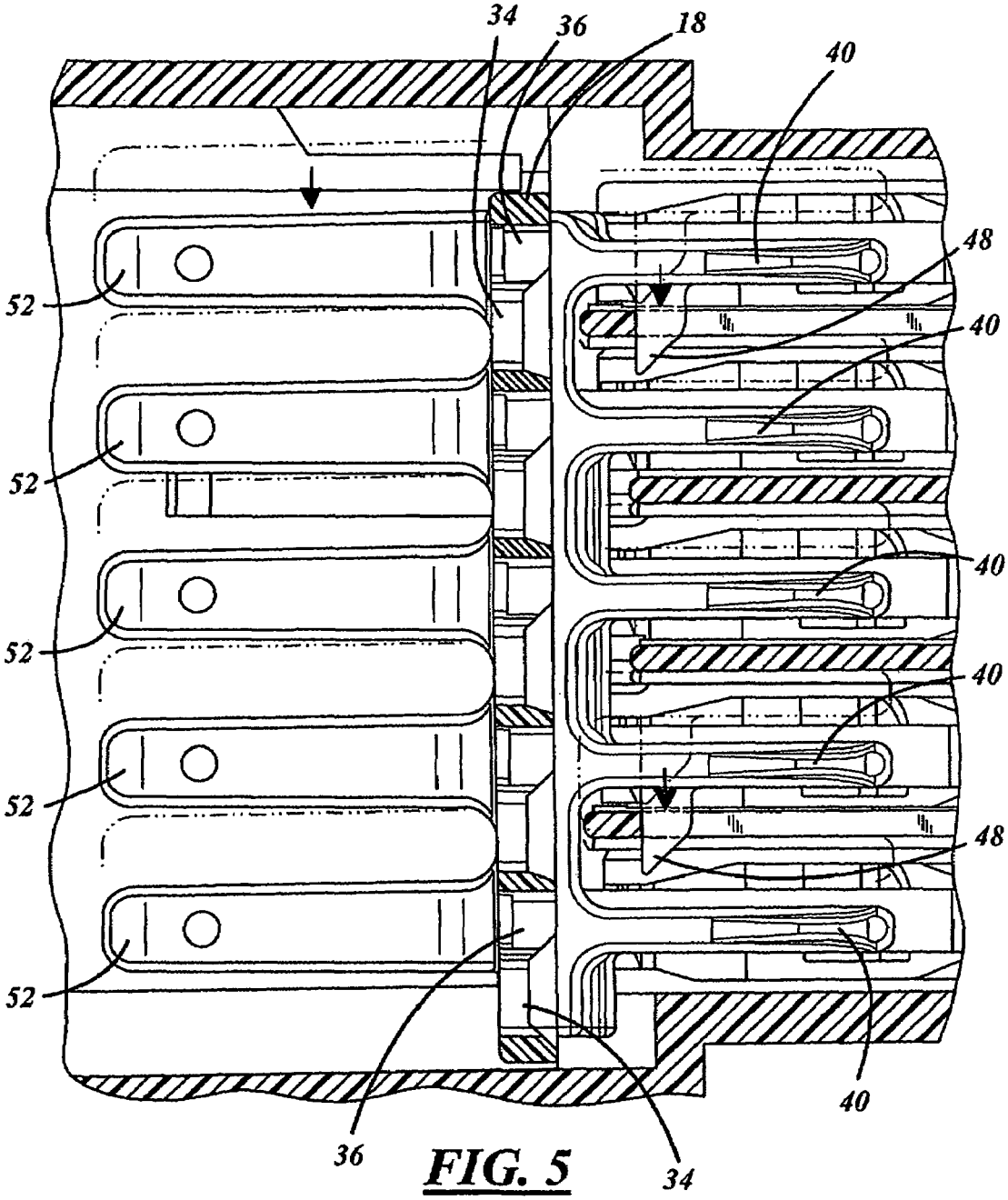
FIG. 5 is a transverse section of the electrical connector taken along the line 5—5 of FIG. 4 looking the direction of the arrows.

The stabilizer 18 is disposed in the socket 24 and moves laterally in the socket between a preload position shown in FIGS. 2 and 3 and a terminal stabilize position shown in FIGS. 4, 5, and 6. Stabilizer 18 has a plurality of generally T-shaped passages 32 comprising enlarged rectangular loading portions 34 and narrow blade stabilizing slots 36 at one side of the loading portions 34.

Loading portions 34 are aligned with the terminal cavities 20 when the stabilizer 18 is in the preload position shown in FIGS. 2 and 3. This preload position of the stabilizer 18 allows the male terminals 14 to be loaded into the connector body 12 by inserting the male terminals 14 into the terminal cavities 20 via openings at the insertion end 22. When the terminals 12 are inserted, the male blades 38 at the forward ends of the terminals 14 project through the enlarged rectangular loading portions 34 of the stabilizer passages 32. These loading portions 34 are of sufficient height to allow the terminals 14 to tilt inwardly and ride over the rigid terminal locks 28 as shown by the partially inserted terminal 14 in a typical lower terminal cavity 20 shown in FIGS. 2 and 3.

After the male terminals 14 are loaded and locked in each of the terminal cavities 20 by the rigid terminal locks 28, the stabilizer 18 is shifted from the preload position shown in FIGS. 2 and 3 to the terminal stabilize position shown in FIGS. 4, 5, and 6. This shifting does two things. The male blades 38 are now captured vertically by the narrow blade stabilizing slots 36 of the passages 32 as best shown by the fully inserted terminal 14 in the typical lower terminal cavity 20 shown in FIGS. 4, 5, and 6. This stabilizes the vertical position of the male blades 38 in the socket 24 thus facilitating connection to a mating connector in which the male blades 38 are received by female terminals of the mating connector (not shown). The vertical stabilization also enhances terminal retention by preventing the terminal from tilting out of full engagement with the rigid terminal locks 28.

Terminal retention is further enhanced by a row of longitudinal fingers 40 that project rearwardly from the stabilizer 18 in vertical alignment with the blade stabilizing slots 36. The shifting of the stabilizer 18 shifts fingers 40 laterally to positions between each pair of flexible beams 30 as best shown in FIG. 6. Each flexible beam 30 is now supported at each end as a simple beam thus enhancing the force of the flexible beams 30 pushing the terminals 14 outwardly into engagement with the rigid terminal locks 28.

Each passage 32 may also include an electrical ring out port 42 that may be used for receiving a test pin from a harness build out fixture (not shown). The pin would register the terminal being in the locked position in the terminal cavity.

Stabilizer 18 may also include a plurality of upper and lower flexible hooks 44 that extend rearwardly and slide behind internal retention grooves 46 at the inboard end of socket 24 to hold the stabilizer 18 in the socket 24 while allowing the stabilizer 18 to shift laterally from the preload position shown in FIGS. 2 and 3 to the terminal stabilizing position shown in FIGS. 4, 5, and 6.

Stabilizer 18 may also include shift slots 47 and slide locks 48. Shift slots 47 cooperate with tabs 49 in socket 24 to limit the lateral shift of stabilizer 18. Slide locks 48 project laterally from selected fingers 40 and cooperate with slots 50 in the terminal cavity side walls to lock the stabilizer 18 in the terminal stabilizing position as best shown in FIG. 5.

Stabilizer 18 may also include a row of anti-scoop towers 52 that project forward into socket 24. The anti-scoop towers protect the male blades 38 when the electrical connector 10 is engaged with a mating electrical connector (not shown) that that has mating female terminals.

It will be readily understood by those persons skilled in the art that the present invention is susceptible of broad utility and application. Many embodiments and adaptations of the present invention other than those described above, as well as many variations, modifications and equivalent arrangements, will be apparent from or reasonably suggested by the present invention and the foregoing description, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the following claims and the equivalents thereof.

We claim:

1. An electrical connector comprising:

a connector body, a male terminal attached to an insulated conductor wires and a stabilizer, the connector body having a terminal cavity that extends through the connector body from an opening at an insertion end to an opening into an integral socket at a mating end of the connector body, the connector body having a rigid terminal lock that projects inward into the terminal cavity for retaining the terminal in the connector body and a cantilevered flexible beam opposite the rigid terminal lock for pushing the terminal into locked engagement with the rigid terminal lock, the stabilizer being shiftably disposed in the socket for lateral movement in the socket between a preload position and a terminal stabilize position, the stabilizer having a passage comprising a loading portion and blade stabilizing portions at one side of the loading portion, the loading portion being aligned with the terminal cavity when the stabilizer is in the preload position to allow the male terminal to be loaded into the connector body by inserting the male terminal into the terminal cavity via the opening at the insertion end so that a male blade at a forward end of the male terminal projects through the loading portion of the stabilizer passage, the loading portion being of sufficient height to allow the terminal to tilt and ride over the rigid terminal lock and into locked engagement with the rigid terminal lock, and the blade stabilizing portion of the passage capturing the male blade vertically when the stabilizer is in the terminal stabilize position to stabilize the vertical position of the male blade in the socket.

2. The electrical connector as defined in claim 1 wherein the stabilizer has a longitudinal finger that is disposed adjacent the cantilevered flexible beam when the stabilizer is in the terminal stabilize position, so that the cantilevered flexible beam is supported at each end as a simple beam thus enhancing terminal retention.

3. The electrical connector as defined in claim 1 wherein the passage is generally T-shaped, the loading portion is an enlarged rectangular loading portion and the blade stabilizing portion is a narrow blade stabilizing slot at one side of the loading portion.

4. The electrical connector as defined in claim 3 wherein the stabilizer has a longitudinal finger that projects rearwardly in vertical alignment with the blade stabilizing slot, the longitudinal finger being disposed adjacent the cantilevered flexible beam when the stabilizer is in the terminal stabilize position so that the cantilevered flexible beam is supported at each end as a simple beam thus enhancing terminal retention.

5. An electrical connector comprising a connector body, a plurality of male terminals attached to insulated conductor wires and a stabilizer, the connector body having a row of terminal cavities that extend through the connector body from an opening at an insertion end to an opening into an integral socket at a mating end of the connector body, the connector body having rigid terminal locks that project inward into the terminal cavities for retaining the terminals in the connector body and cantilevered flexible beams opposite the rigid terminal locks for pushing the terminals inward into locked engagement with the rigid terminal locks, the stabilizer being shiftably disposed in the socket for lateral movement in the socket between a preload position and a terminal stabilize position, the stabilizer having a plurality of passages comprising loading portions and blade stabilizing portions at one side of the loading portions, the loading portions being aligned with the terminal cavities when the stabilizer is in the preload position to allow the male terminals to be loaded into the connector body by inserting the male terminals into the terminal cavities via the openings at the insertion end so that male blades at forward ends of the terminals project through the loading portions of the stabilizer passages, the loading portions being of sufficient height to allow the terminals to tilt and ride over the rigid terminal locks and into locked engagement with the rigid terminal locks, and the blade stabilizing portions of the passages capturing the male blades vertically when the stabilizer is in the terminal stabilize position to stabilize the vertical position of the male blades in the socket thus facilitating connection to a mating connector in which the male blades are received by female terminals of the mating connector.

6. The electrical connector as defined in claim 5 wherein the stabilizer has a row of longitudinal fingers that are disposed adjacent respective ones of the cantilevered flexible beams when the stabilizer is in the terminal stabilize position, so that each cantilevered flexible beam is supported at each end as a simple beam thus enhancing terminal retention.

7. The electrical connector as defined in claim 5 wherein the passages are generally T-shaped, the loading portions are enlarged rectangular loading portions and the blade stabilizing portions are narrow blade stabilizing slots at one side of the loading positions.

8. The electrical connector as defined in claim 7 wherein the stabilizer has a row of longitudinal fingers that project rearwardly in vertical alignment with the blade stabilizing slots, the longitudinal fingers being disposed adjacent respect ones of the cantilevered flexible beams when the stabilizer is in the terminal stabilize position so that each cantilevered flexible beam is supported at each end as a simple beam thus enhancing terminal retention.

9. An electrical connector comprising a connector body, a plurality of male terminals attached to insulated conductor wires and a stabilizer, the connector body having two parallel rows of terminal cavities that extend through the connector body from an opening at an insertion end to an opening into an integral socket at a mating end of the connector body, the connector body having rigid terminal locks that project inward into the terminal cavities for retaining the terminals in the connector body and cantilevered flexible beams opposite the rigid terminal locks for pushing the terminals outward into locked engagement with the rigid terminal locks, the stabilizer being shiftably disposed in the socket for lateral movement in the socket between a preload position and a terminal stabilize position, the stabilizer having passages comprising loading portions and blade stabilizing portions at one side of the loading portions, the loading portions being aligned with the terminal cavities when the stabilizer is in the preload position to allow the male terminals to be loaded into the connector body by inserting the male terminals into the terminal cavities via the openings at the insertion end so that male blades at forward ends of the terminals project through the loading portions of the stabilizer passages, the loading portions being of sufficient height to allow the terminals to tilt inwardly and ride over the rigid terminal locks and into locked engagement with the rigid terminal locks, and the blade stabilizing portions of the passages capturing the male blades vertically when the stabilizer is in the terminal stabilize position to stabilize the vertical position of the male blades in the socket thus facilitating connection to a mating connector in which the male blades are received by female terminals of the mating connector.

10. The electrical connector as defined in claim 9 wherein the stabilizer has a row of longitudinal fingers that are disposed between respective pairs of flexible beams when the stabilizer is in the terminal stabilize position, so that each cantilevered flexible beam is supported at each end as a simple beam thus enhancing terminal retention.

11. The electrical connector as defined in claim 9 wherein the passages are generally T-shaped, the loading portions are enlarged rectangular loading portions and the blade stabilizing portions are narrow blade stabilizing slots at one side of the loading positions.

12. The electrical connector as defined in claim 11 wherein the stabilizer 18 has a row of longitudinal fingers that project rearwardly in vertical alignment with the blade stabilizing slots, the longitudinal fingers being disposed between pairs of flexible beams when the stabilizer is in the terminal stabilized position so that each flexible beam is supported at each end as a simple beam thus enhancing terminal retention.

13. The electrical connector as defined in claim 11 wherein the stabilizer has a row of longitudinal anti-scoop towers that project forwardly to protect the male blades.

* * * * *